US007592073B2

(12) United States Patent
Brockmeyer et al.

(10) Patent No.: US 7,592,073 B2
(45) Date of Patent: Sep. 22, 2009

(54) RHENIUM COMPOSITE ALLOYS AND A METHOD OF PREPARING SAME

(75) Inventors: Jerry W. Brockmeyer, Santa Clarita, CA (US); Clifford C. Bampton, Thousand Oaks, CA (US)

(73) Assignee: The Boeing Company, Chicago, IL (US)

( * ) Notice: Subject to any disclaimer, the term of this patent is extended or adjusted under 35 U.S.C. 154(b) by 595 days.

(21) Appl. No.: 11/236,025

(22) Filed: Sep. 27, 2005

(65) Prior Publication Data

US 2008/0003452 A1 Jan. 3, 2008

(51) Int. Cl.
*B32B 15/00* (2006.01)
*C22C 27/00* (2006.01)

(52) U.S. Cl. ..... 428/655; 420/433; 420/400

(58) Field of Classification Search ..... None
See application file for complete search history.

(56) References Cited

U.S. PATENT DOCUMENTS 6,773,663 B2 * 8/2004 Adams ..... 420/433
6,821,313 B2 * 11/2004 Adams ..... 75/247
6,946,096 B2 * 9/2005 Giesler et al. ..... 419/10
2006/0062985 A1 * 3/2006 Karandikar ..... 428/292.1
2007/0074601 A1 * 4/2007 Hong et al. ..... 75/345
2007/0116890 A1 * 5/2007 Adams et al. ..... 427/569

FOREIGN PATENT DOCUMENTS

JP 02-111823 * 4/1990

* cited by examiner

*Primary Examiner*—John J Zimmerman
(74) *Attorney, Agent, or Firm*—Alston & Bird LLP

(57) ABSTRACT

A rhenium alloy is provided having from about 50 atomic % to 99 atomic % rhenium and a refractory compound particulates that are present in the alloy in an amount up to about 10 atomic %. The refractory compound comprises a nano-scale dispersion that is incorporated into the conventional rhenium structure. The nano-scale dispersion acts as grain boundary pins that result in a relatively fine grained, equiaxed structure that improves the mechanical properties of the alloy and helps to minimize the growth of large grains during operations at high temperatures. As a result, the amount of the rhenium used in high temperature applications may be reduced without sacrificing its high temperature and mechanical properties. Cryomilling in the presence of nitrogen may be used to prepare the rhenium alloy having a stable fine grain structure at high temperatures.

20 Claims, 2 Drawing Sheets

RHENIUM COMPOSITE ALLOYS AND A METHOD OF PREPARING SAME

BACKGROUND OF THE INVENTION

The present invention relates generally to cryomilled alloys and more particularly to cyromilled rhenium alloys.

The aerospace industry is increasingly becoming more competitive. To compete in the industry, it is necessary to develop propulsion systems that are low cost and can efficiently deliver high payloads. Rocket propulsion systems are commonly used for delivering payloads and spacecraft into space.

Many rocket propulsion systems use either a pressure fed system or a turbopump system that transfers propellants to the combustion chamber where they are mixed and burned to produce a high velocity stream of heated gases. The stream of heated gases is then exhausted through one or more nozzles to provide the desired thrust. Typically, combustion takes place at temperatures that may be in excess of 6000 F., which may be higher than the melting point of most conventional engine materials. As a result, in the absence of active cooling, it may be necessary to line the interior of the combustion chamber with a material having a high melting point and oxidation resistance.

Iridium-coated rhenium is a material that is commonly used to line the interior of the combustion chamber. Iridium provides high temperature oxidation resistance and has an intrinsic resistance to oxidation. Rhenium has a higher melting point than iridium and excellent high temperature structural capability. Iridium and rhenium are dense materials that are prohibitively expensive. As a result, the use of iridium and rhenium may increase the overall cost and weight of the propulsion system. Rhenium has also been advantageously used in solid rocket motor applications.

The processing of rhenium also presents several challenges. In many applications, chemical vapor deposition (CVD) fabrication is used. Typically, high temperatures are needed to deposit rhenium using CVD. However, conventional equipment for CVD produces temperatures on the order of 1000° C., which is much lower than the melting point of rhenium. CVD also typically requires relatively expensive starting materials and processing reactors that are relatively expensive to run and maintain. Other methods of processing rhenium, such as electrodeposition, may also present challenges and may result in the rhenium having an undesirable grain size. Post-processing, e.g. machining of rhenium, may also be difficult because of the high work hardening coefficient of rhenium.

The advantageous properties of rhenium may also be adversely affected, in part, by the processing conditions. For instance, in many cases rhenium properties may be dynamic when exposed to high temperatures. This dynamic behavior may result from grain growth that can occur at higher operating temperatures. Grain growth may decrease the mechanical properties of rhenium. Additionally, current methods of processing rhenium typically result in relatively large grain structures or grain structures that have an acicular grain structure. Such grain structures tend to increase the difficulty of processing rhenium and may also result in the rhenium having reduced mechanical properties, such as strength, at higher operating temperatures.

Thus, there still exists a need for a rhenium alloy and a method of processing rhenium that minimizes the level of rhenium that is required without decreasing the mechanical properties and high melt temperature of rhenium.

BRIEF SUMMARY OF THE INVENTION

Embodiments of the invention provide a rhenium composite alloy that overcomes many of the limitations discussed above. In one aspect, a rhenium alloy is provided having from about 50 atomic % to 99 atomic % rhenium and a plurality of refractory compound particulates that are present in the alloy in an amount up to about 10 atomic %. The refractory compound comprises a nano-scale dispersion that is incorporated into the conventional rhenium structure. The nano-scale dispersion acts as grain boundary pins that result in a relatively fine grained, equiaxed structure that helps to improve the mechanical properties of the alloy and helps to minimize the growth of large grains during operations at high temperatures. As a result, the amount of the rhenium used in high temperature applications may be reduced without sacrificing its high temperature and mechanical properties.

In one embodiment, the refractory compound comprises a compound having a high melt temperature that is selected from the group consisting of refractory oxides, carbides, nitrides, borides, oxy-nitrides and carbo-nitrides. The refractory compound may comprise a high melting temperature metal so the resulting refractory compound does not adversely affect the melting temperature of the conventional rhenium structure. Suitable metals may include, without limitation, hafnium (Hf), zirconium (Zr), tantalum (Ta), silicon (Si), vanadium (V), and titanium (Ti). In one embodiment, the refractory compounds comprise hafnium nitrides, hafnium carbide or carbon nanotubes. The amount of the refractory compound that may be present in the rhenium alloy may be varied to form an alloy having desired mechanical properties. Typically, the amount of refractory material is up to about 10 atomic %, with about 0.4 to 5 atomic % being more typical. In one embodiment, the rhenium alloy comprises less than 2 atomic % of the refractory compound.

In some embodiments, the rhenium alloy may also include up to about 50 atomic % tungsten or molybdenum, or combination thereof. Incorporating tungsten or molybdenum into the alloy may help to minimize the amount of rhenium in the alloy without sacrificing the high melt temperature or the mechanical properties that are commonly associated with rhenium.

The rhenium alloys of embodiments of the invention may be prepared from mechanical alloying methods, such as cryomilling. In one embodiment, rhenium is combined with another metal constituent that forms the refractory compound and then is cryomilled in the presence of liquid nitrogen. The metal constituent reacts with the nitrogen to form nitrides having a nano-scale structure. The nitrides act as grain boundary pins that substantially reduce or prevent rhenium grain growth at temperatures up to at least about 2,000° C. In some embodiments, the rhenium alloy has a stable grain structure at temperatures of at least about 3,000° C. The resulting rhenium alloy powders may then be processed into useful forms. Rhenium alloys prepared in accordance with embodiments of the invention may be processed via conventional powder metallurgy processing methods and may thus overcome many of the aforementioned difficulties that may be associated with processing rhenium.

Thus, various embodiments of the invention provide a rhenium alloy and a method of processing the rhenium without sacrificing the high melt temperature or mechanical properties of the rhenium.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Figure 1:
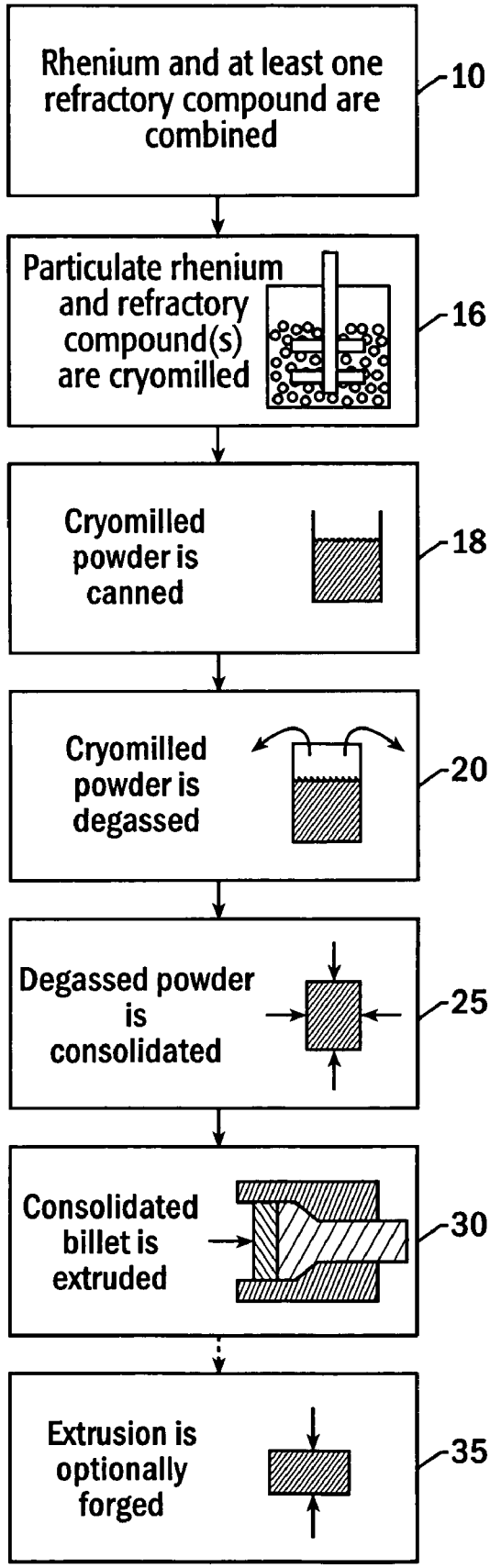
FIG. 1 is a schematic flow diagram of a method in accordance with an embodiment of this invention.

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Embodiments of the invention provide a rhenium composite alloy that includes a high melt temperature refractory compound that is present in the alloy in an amount up to about 10 atomic %. As used herein, "alloy" describes the solid solution of rhenium and one or more high melt temperature refractory compounds. In addition, the solid solution may also contain tungsten and/or molybdenum. As with any alloys, the invented alloy may contain very low concentrations of a variety of contaminants or impurities.

The rhenium alloy of embodiments of the invention may have improved mechanical properties in comparison to conventionally processed rhenium. In one embodiment, the rhenium alloy has a melting temperature that is in excess of 2500° C. In this regard, the melt temperature of the rhenium alloy may be in excess of 2800° C., 2850° C., and 3000° C., such as in excess of 3400° C. In some embodiments, the rhenium alloy has an average grain that may be less than 0.5 μm, such as less than 0.1 μm.

In some applications it may be desirable to alloy rhenium with a relatively less expensive and/or lower density refractory metal, such as molybdenum. Although alloying with an additional metal constituent, such as molybdenum, may tend to reduce the melting point of the alloy relative to that of unalloyed rhenium, it may provide a beneficial reduction in both weight and cost without prohibitively reducing the desirable properties of rhenium. In some high temperature applications, such as solid rocket motor applications, it may be desirable to alloy rhenium with tungsten. Tungsten provides a dense material that has a melting point higher than rhenium. Tungsten is also typically less expensive than rhenium. As a result, rhenium may be alloyed with tungsten so that the resulting alloy may provide a beneficial combination of properties and cost. In some embodiments, the rhenium alloy may comprise up to about 50 atomic % tungsten, molybdenum, or a combination thereof.

In one embodiment, the rhenium alloy comprises from about 50 to 99 atomic % and a refractory compound that is present in the alloy in an amount up to about 10 atomic %. In another embodiment, the rhenium alloy comprises from about 90 to 99 atomic % rhenium and no more than about 2 atomic % of the refractory compound. The refractory compound has a melting temperature that is sufficiently high so that the rhenium alloy has a melting temperature of at least 2700° C., and typically greater than about 3000° C. In one embodiment, the refractory compound may be dispersed throughout the rhenium alloy and have a melting point when dispersed in the alloy of at least about 1900° C. (3450° F.). Suitable refractory compounds include refractory oxides, carbides, nitrides, borides, oxy-nitrides and carbo-nitrides that are able to produce stable nano-scale pins within the rhenium structure and that do not substantially decrease the melting point of rhenium alloy below that of non-alloyed rhenium. Typically, the refractory compounds comprise a plurality of nano-scale particles having an average diameter between 2 and 5 nm. In some embodiments, the spacing between the refractory compound particulates is between 10 and 40 nm, with an average spacing less than 30 nm being preferred, and an average spacing of about 20 nm being more typical.

In some embodiments, the refractory compounds may include a metal constituent having a high melt temperature. The metal constituent also referred to herein as a "refractory metal" comprises a metal that forms stable nano particulates in combination with one or more of oxygen, nitrogen, or carbon. Suitable refractory metals may include one or more of hafnium (Hf), zirconium (Zr), tantalum (Ta), silicon (Si), vanadium (V), and titanium (Ti).

In another embodiment, the refractory compound may comprise carbon nanotubes that have been incorporated into the rhenium structure. The use of carbon nanotubes may be advantageous in rocket propulsion systems where it is desirable to decrease weight. Carbon nanotubes, similar to the refractory compounds discussed above, may act as nano-scale pins that help prevent the growth or the rhenium grains at higher temperatures. Carbon nanotubes typically have a lower density and weight than refractory compounds containing refractory metals. As a result, the overall weight/density of the rhenium alloy may be reduced which may result in reduced weight structures and/or enhanced density-specific properties.

Various types of carbon nanotubes may be commercially available. Carbon nanotubes are typically comprised of carbon atoms arranged in geometric arrays forming nano scale structures. Bulk properties of the nano-tubes are on the order of bulk properties for graphite. Carbon nanotubes may be mechanically incorporated within the rhenium alloy structured by addition to the mill bath. In some embodiments, the carbon nanotubes may be treated with a surface active agent to help improve dispersion within the alloy. In one embodiment, the carbon nanotubes have an average diameter that is less than 200 nm, and in some embodiments, less than 100 nm. The carbon nanotubes may have a density from 1.2 to 3.5 $g/cm^3$, with a density of about 1.8 $g/cm^3$ being somewhat more typical.

As discussed above, the rhenium alloy may also include up to about 50% tungsten or molybdenum or a combination thereof. The presence of molybdenum and/or tungsten in the rhenium alloy may help impart desirable mechanical properties to the rhenium alloy. In some embodiments, the use of an additional metal in combination with rhenium may also help to lower the overall cost that may be associated with the alloy.

In one embodiment, the rhenium alloy may be produced with cryomilling. As used herein, "cryomilling" describes the fine milling of metallic constituents at extremely low temperatures. Cryomilling takes place within a high energy mill such as an attritor with metallic or ceramic balls. During milling, the mill temperature is lowered by using liquid nitrogen or a similar compound to a temperature of between −240° C. and −150° C. In an attritor, energy is supplied in the form of motion to the balls within the attritor, which impinge portions of the metal alloy powder within the attritor, causing repeated comminuting and welding of the metal.

Surprisingly, rhenium alloys of embodiments of the invention prepared via cryomilling result in alloy powders that may be processed with conventional powder metallurgy processing methods. In addition, the refractory compounds maintain the fine grain structure of the rhenium throughout subsequent processing, even at elevated temperatures.

Advantageously, in one embodiment, the refractory compounds may be prepared in situ during the cryomilling process through the interaction of nitrogen with the refractory metal. Continued cryomilling of the alloy constituents results in a rhenium having a fine grained, equiaxed microstructure that includes a dispersion of nano sized refractory compounds that are dispersed throughout the alloy. In an alternative embodiment, previously prepared nano-scale refractory compounds may be cryomilled with the rhenium to produce a fine grained structure. Such prepared refractory compounds may include carbon nanotubes, carbides, nitrides, and in particular hafnium nitride and/or hafnium carbide.

The high-strength metal alloy powders, extrusions, and forgings of embodiments of this invention may begin as a pre-alloyed metal or as a combination of metals in the form of small particulates or powder. The base metal of the alloy is rhenium, which makes up between 50% and 99% of the alloy by weight. The metal constituent ("the refractory metal") of the refractory compound may include one or more of hafnium (Hf), zirconium (Zr), tantalum (Ta), silicon (Si), vanadium (V), and titanium (Ti), which makes up between 0.1% and 10% of the alloy by weight. In some embodiments, tungsten and/or molybdenum may optionally be used in combination with the rhenium and refractory metal to form alloys. When intimately combined, mixed, and milled, the rhenium and tungsten/molybdenum form a solid solution.

If the beginning rhenium powder is supplied as pre-alloyed, then it can proceed directly to the cryomilling process. Metal powders that have not been previously alloyed can also proceed to the cryomilling step, since the cryomilling will intimately mix the rhenium constituent with the tungsten/molybdenum constituent and thereby alloy the metals.

In some embodiments, it may be desirable to maintain the starting metal powders in a substantially oxygen free atmosphere prior to milling. For instance, the rhenium powder may be supplied by atomizing the rhenium in an argon environment, followed by handling and storing the powder in clean, dry argon or nitrogen. The rhenium may be held under inert environment throughout all storage and handling operations prior to milling to inhibit the oxidation of the surface of the rhenium particles. The inert atmosphere may also prevent contaminants such as moisture from entering the raw metal powder, which could provide contaminated particle surfaces that interfere with consolidation and that lower ductility. Since other metals readily oxidize, it may be desirable to handle them in the same manner as rhenium prior to milling. Thus, the rhenium and other metal powders may be supplied uncoated, meaning without a coating of metal oxides.

The use of source metal powder having oxide coatings does not completely destroy the strength and low temperature benefits gained through embodiments of the invented process, but alloys produced with a minimum of oxide content may be advantageous. In one embodiment, rhenium alloys having almost no oxide content may be produced in accordance with embodiments of this invention.

Referring now to FIG. 1, once the constituents of the rhenium alloy are selected 10, the combined or pre-alloyed metal powder is cryomilled 16. As noted above, cryomilling is the repeated comminuting and welding of the metal particles in a very low temperature environment.

Figure 2:
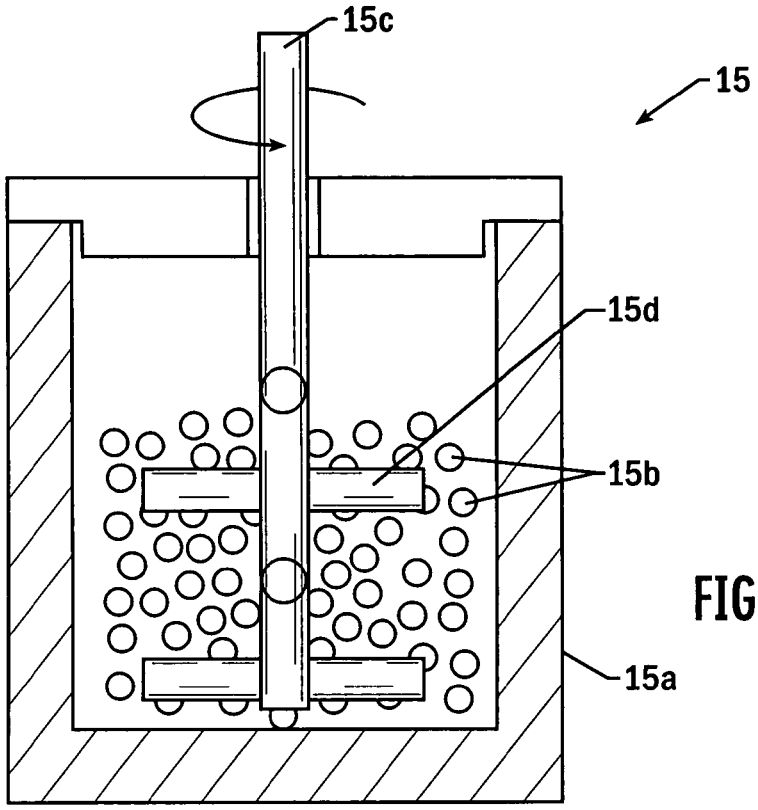
FIG. 2 is a side sectional view of an exemplary ball mill and attritor for use in an embodiment of the invention.

It is typical that the cryomilling 16 of the very small particles of metal powder take place within a ball attritor. As shown in FIG. 2, the ball attritor is typically a cylindrical vessel 15*a* filled with a large number of ceramic or metallic spherical balls 15*b*, typically formed of stainless steel. A single fixed-axis shaft 15*c* is disposed within the attritor vessel, and there are several radial arms 15*d* extending from the shaft. As the shaft 15*c* is turned, the arms 15*d* cause the spherical balls 15*b* to move about the attritor. When the attritor contains metal powder and the attritor is activated, portions of the metal powder are impinged between the metal balls 15*b* as they move about the attritor. The force of the metal balls 15*b* repeatedly impinges the metal particles and causes the metal particles to be continually comminuted and welded together. This milling of the metal powder effectively cold-works the metal.

In one embodiment, a surfactant, such as stearic acid, may be included as one of the constituents introduced into the attritor along with the metal powders and liquid nitrogen. Stearic acid may help promote the fracturing and rewelding by limiting the rewelding efficiency, which in turn may promote the development of the fine grain size within the alloy powders. The amount of stearic acid added to the attritor is typically about 0.2 weight percent and generally not more than about 2 weight percent. The process is believed to not require stearic acid, as long as process parameters are adjusted to allow for the different milling process in the absence of stearic acid.

Cold working imparts a high degree of plastic strain within the powder particles. During cold working, the repeated deformation causes a buildup of dislocation substructure within the particles. After repeated deformation, the dislocations evolve into cellular networks, and then further evolve into high-angle grain boundaries that define the boundaries of the very fine grains of the metal. As-milled grain sizes in these metal powders are on the order of 50 to 100 nm ($10^{-9}$ m).

During milling 16, the metal powder is reduced to and held at a temperature of, for example, −320° F. in a slurry of liquid nitrogen. In some embodiments, the metal powder is held within a temperature range from about −150° F. to −320° F. The liquid nitrogen is a convenient way to lower the temperature of the entire cryomilling system. Also, surrounding the metal powder in liquid nitrogen limits exposure of the metal powder to oxygen or moisture. In operation, the liquid nitrogen is placed inside the attritor, in contact with the metal particles and the attritor balls.

Though slight variations of temperature within the attritor will not be detrimental to the finished alloy, the temperature within the attritor is preferably held constant during milling 16. The temperature of the liquid nitrogen bath is dependent upon the pressure at which it is maintained, so target temperatures can be achieved by varying the pressure above the liquid nitrogen.

The operating parameters of the cryomilling 16 will depend upon the size of the attritor. For example, a 15 kg (batch size) attritor is preferably operated at a speed of between about 80 rpm and about 150 rpm. The amount of powder added to the attritor is dependent upon the size and number of balls within the attritor vessel. For a 125 liter attritor filled with 1400 lbs. of 0.25" diameter steel balls, based on volumetric considerations, up to approximately 390 lbs. of rhenium powder may be milled at any one time with a lesser weight likely dependent upon the density and flow characteristics of the specific Re-based alloy being milled.

Milling 16 is continued for a time sufficient to reach an equilibrium nanostructured grain size within the metal. It has been found that, when liquid nitrogen is used as the cooling liquid, the nitrogen content of the milled alloy corresponds to the extent of milling of the metal and the initial concentration of the refractory metals. Thus, in embodiments where the refractory compounds are prepared in situ, it may be desirable to mill the alloy for a time sufficient to produce a desired level of the refractory compounds, typically between 0.1 and 10 percent. In one embodiment, a milled alloy powder having well dispersed metal constituents may have a nitrogen content of between 0.3% and 0.6% by weight. Thus, as a guideline, the rhenium powder is typically milled 16 until the nitrogen content of the alloy reaches between 0.3% to 0.6% by weight of the alloy.

After milling 16, the rhenium alloy powder is a homogenous solid solution of rhenium and dispersed refractory compounds and, optionally, tungsten and/or molybdenum. Depending on the alloy and extent of milling, the average grain size in the as-milled powder may be lower than 0.5 μm, such as lower than 0.1 μm.

Referring back to FIG. 1, after a rhenium alloy powder having a desired composition and grain structure is produced, it may be transformed into a form that may be shaped into a useful object. The rhenium alloy powder may be canned 18, degassed 20, and then compacted and welded 25. After the combined step of compacting and welding 25, also referred to as consolidating 25, the metal is a solid mass which may be worked and shaped. The consolidated rhenium powder may be extruded 30 into a usable metal component, and forged 35 if necessary.

In some embodiments, from cryomilling 16 through the completion of consolidation 25, the rhenium alloy powder is handled in either a dry nitrogen atmosphere, an argon atmosphere, or a vacuum. The inert atmosphere prevents oxidation of the surface of the alloy powder particles. The inert atmosphere further prevents the introduction of moisture to the alloy and prevents other contaminants, which might be problematic in the extruded solid, from entering the powder.

Canning 18 of the rhenium alloy powder involves placing the powder within a sealed airtight container. The container, or can, is equipped with an evacuation port to be used in subsequent degassing 20. The rhenium alloy powder is degassed 20 while held in the can. A vacuum pump is operatively attached to the evacuation port of the can and used to provide a vacuum of approximately $10^{-6}$ torr or better. The temperature of the rhenium alloy is raised, concurrently with the vacuum treatment, to a temperature of between about 300° F. and about 1,000° F., and typically about 500° F. to about 800° F. The elevated temperature and decreased pressure cause the evacuation of gaseous components from the metal alloy powder.

The degassing 20 removes components of any stearic acid included with the powder rhenium blend when cryomilled within the attritor. Hydrogen, which evolves from the stearic acid, is the main degassed component. Nitrogen found within the interstices of the powder, and nitrogen from the powder-handling environment may also be degassed. Small amounts of oxygen or moisture present within the powder may also be removed from the powder during the degassing. Degassing 20 is theoretically continued in one embodiment until no free gas species remain in the alloy powder, but is practically continued until the vacuum level at the vacuum pump inlet is steady at below about $10^{-6}$ torr, and the content of hydrogen is below 5 weight parts per million (wppm), as-measured in HIP compacts, extrusions or forgings.

The fine grain size of the rhenium alloy has the unique and useful property of being stable on annealing to temperatures of about 2000° C. This enables the powder to endure the relatively high temperatures experienced during degassing 20 and consolidation 25 while maintaining the fine grain size that contributes to strength. In addition, the fine grain structure of the rhenium alloy is stable at temperatures in excess of 2500° C., including temperatures in excess of 3000° C.

After degassing 20, the rhenium alloy powder may be transferred to a hot isostatic press (HIP). In one embodiment, the temperature of the powder is either maintained at between about 1200° C. to about 1600° C. after degassing 20 or, if the temperature of the alloy has been allowed to drop, reheated to between about 1200° C. to about 1600° C. While maintaining the elevated temperature, the external surface of the can is pressurized with argon and compressed within the press at a static pressure of between about 15 ksi and about 30 ksi. The temperature and pressure exerted upon the powder container cause the metal particles to be consolidated into a singular solid billet. The pressure and temperature are maintained until the mass of consolidated metal is nearly 100% free of porosity. Though pressing times will vary with the exact alloy being consolidated, a typical hot isostatic pressing time will be approximately 4 hours.

The hot isostatic pressing (HIPing) generally takes place while the metal is sealed within the degassing can. Under such circumstances, the high-pressure argon, or other inert gas, simply deforms the can, consolidating the metal powder within the can. Other powder consolidation methods are feasible, such as direct extrusion or forging of powder under vacuum.

After consolidation 25, the solid rhenium alloy is extruded 30. Extrusion 30 may be used to form the solid into a blank for later forging or may be used to form the solid metal directly into a usable part. The extrusion process typically alters the physical properties of the alloy somewhat. For instance, extrusion decreases the hardness and increases the grain size of the consolidated billet. Also, tensile ductility is notably improved after extrusion.

Figure 3:
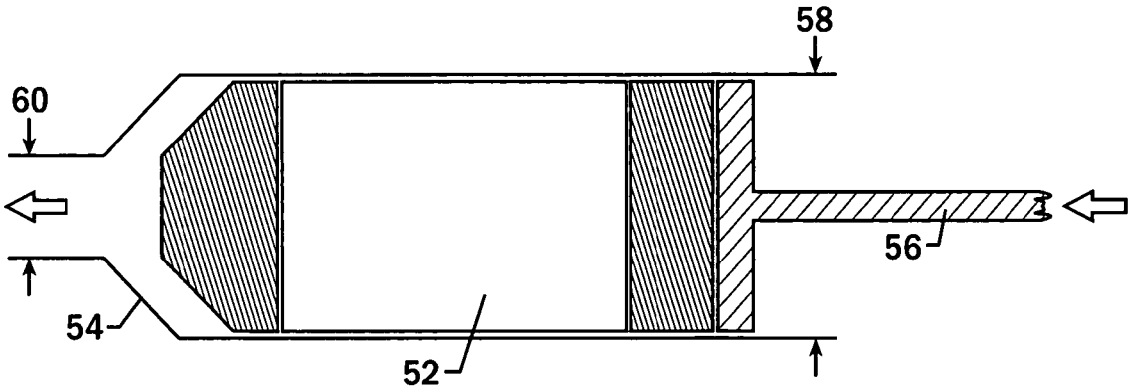
FIG. 3 is a side sectional view of an exemplary extrusion apparatus in accordance with an embodiment of the invention.

Referring to FIG. 3, the consolidated alloy may be shaped in the form of a cylindrical billet 52 having a first diameter 58. The rhenium alloy billet 52 is forced through a conical die 54 by a ram 56. When the consolidated alloy 52 is extruded, the diameter of the billet is reduced to a second diameter 60 and the length of the billet 52 is extended. For extrusion 30, the alloy is heated to a temperature between about 500° C. and 1500° C., such as about 1000° C. In one embodiment, extrusion 30 of the alloy may occur at greater than a 6 to 1 extrusion area ratio. Ram speed for extrusion of the alloy may be, for example, about 20 inches per minute.

Components formed from the metal alloy may be forged 35 if extrusion is not capable of producing a part of the proper shape or size. It may also be desired to forge those components which need additional ductility in a direction other than the direction of extrusion.

Prior to forging 35, the extruded blank is heated, such as to a temperature of approximately 1200° C. The blank is first forged 35 at a low strain rate, sufficient to shape the component, and to provide isotropic structure and properties to the alloy. Strain rate during the first forging is typically less than 0.02 per second. The alloy component is then die forged at a strain rate as high as 0.1 per second.

Final forging involves reheating the forged part to about 1200° C. and forging the part at a strain rate of less than 0.1 per second. In one example, forging may impart a total strain to the alloy of from about 0.4 to about 0.8. After final forging, the part is generally cooled, such as by being air cooled. In some cases, high strain rate forging may be preferred since this may avoid excessive heating of the forging dies and may permit the use of lower cost alloy dies.

The physical properties of the alloy are present within the invented alloy powder produced in accordance with embodiments of the invention, and are exhibited by the metal alloy components formed through consolidation and extrusion of the metal, and optionally by further forging of the metal. The extraordinary strength and the ability of the alloy to maintain high strength at extremely high temperatures is believed to be due to the unique grain size, grain structure, and interaction of refractory compounds of the alloy caused by the cryomilling process. The metal components produced from the powder may have an extremely high yield strength, such as between about 40 ksi and about 60 ksi in an unworked condition, and ultimate tensile strength, such as between about 120 ksi and about 150 ksi, each at room temperature. Additionally, the metal alloys may have the same or higher yield strength at high temperatures, such as ranging from about 40 ksi at about 2500° F. to about 15 ksi at 3500° F. Similarly, the ultimate tensile strength of the alloys may range from about 60 ksi at about 2500° F. to about 25 ksi at 3500° F.

In one embodiment, the rhenium alloy comprises 90 to 99 atomic % rhenium and no more than about 2 atomic % of a refractory compound selected from the group consisting of Hf, Zr, Ta, Si, V, and Ti. The resulting rhenium alloy may have a melting point that is at least 3000° C. and a yield strength ranging from about 10 ksi to about 20 ksi at 3500° F.

Metallic constituents in addition to rhenium and the refractory metal may be combined into the metal alloy in accordance with embodiments of the invented milling processes. For instance, any or a combination of alkaline metals, transition metals, and metals selected from column 3b, 4b, 5b, and 6b of the periodic table may be combined with the rhenium. In particular, molybdenum and tungsten can be used in accordance with the processes of embodiments of this invention to produce a rhenium alloy that may have greater high temperature strength than conventionally processed rhenium.

An exemplary embodiment of an alloy which exhibits superior strength characteristics is the alloy containing about 50% to about 99% rhenium, about 0.1% to about 2% hafnium nitride, and up to 50% tungsten and/or molybdenum. Cryomilling, consolidating, and extruding the alloy may produce a metal part having high temperature strength and ductility superior to conventionally processed rhenium Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A rhenium alloy comprising:

from 50 atomic % to 99 atomic % rhenium and at least one refractory compound comprised of nitrides wherein the nitrides have a collective nitrogen content that is from about 0.3 to 0.6% by weight of the alloy, and wherein the alloy has a melting point that is at least 5200° F. and a yield strength of about 15 ksi at 3500° F.

2. A rhenium alloy according to claim 1, wherein the refractory compound has a melting point when dispersed in the alloy of at least 3450° F.

3. A rhenium alloy according to claim 1, wherein the alloy includes a plurality of carbon nanotubes dispersed throughout the rhenium alloy and having an average molecular density of about 1.8 g/cm$^3$.

4. A rhenium alloy according to claim 3, wherein the average distance between carbon nanotubes in the rhenium alloy is between 10 and 40 nm and the average diameter of each carbon nanotube is from 100 to 200 nm.

5. A rhenium alloy according to claim 1, further comprising up to about 50 atomic % tungsten, molybdenum, or a combination thereof.

6. The rhenium alloy according to claim 1, wherein the alloy has an average grain size of less than 5 μm.

7. The rhenium alloy according to claim 1, wherein the alloy is prepared by cryomilling rhenium powder in the presence of cryogenic nitrogen to produce a powder comprising rhenium alloy and nitrides dispersed therein, wherein the amount of nitrogen in said nitrides is from about 0.3 to 0.6% by weight of the alloy.

8. The rhenium alloy according to claim 7, wherein the refractory compound comprises nitrogen and a refractory metal selected from the group consisting of Hf, Zr, Ta, Si, V, and Ti.

9. The rhenium alloy according to claim 1, wherein the alloy has no oxide content.

10. A rhenium alloy comprising:

from 50 atomic % to 99 atomic % rhenium; and at least one refractory compound that is present in the alloy in an amount up to about 10 atomic %, the refractory compound having a melting point of at least 2700° C. and including a combination of nitrogen and one or more metals selected from the group consisting of Hf, Zr, Ta, Si, V, and Ti, wherein the rhenium alloy has a melting point that is at least 3000° C.

11. The rhenium alloy according to claim 10, further comprising up to about 50 atomic % tungsten, molybdenum, or a combination thereof.

12. The rhenium alloy according to claim 10, wherein the alloy further includes carbides, carbon nanotubes, or a combination thereof.

13. The rhenium alloy according to claim 10, wherein the rhenium alloy has a stable grain structure up to at least 2000° F.

14. The rhenium alloy according to claim 10, wherein the rhenium alloy has a stable grain structure up to about 3500° F.

15. The rhenium alloy according to claim 10, wherein the alloy comprises at least 0.3% nitrogen by weight.

16. The rhenium alloy according to claim 10, wherein the alloy has an average grain size of less than 1 μm.

17. The rhenium alloy according to claim 10, wherein the alloy comprises 90 to 99 atomic % rhenium and no more than about 2 atomic % of a refractory compound, and wherein the refractory compound includes a refractory metal selected from the group consisting of Hf, Zr, Ta, Si, V, and Ti, and the rhenium alloy has a melting point that is at least 3000° C. and a yield strength ranging from about 10 ksi to about 20 ksi at 3500° F.

18. The rhenium alloy according to claim 10, wherein the alloy is an extruded rhenium alloy.

19. The rhenium alloy according to claim 10, wherein the alloy is a forged rhenium alloy.

20. A propulsion system having a combustion chamber and the rhenium alloy of claim 10 disposed on at least a portion of an inner surface of the combustion chamber.

* * * * *